United States Patent [19]

Hafner

[11] Patent Number: 4,779,331

[45] Date of Patent: Oct. 25, 1988

[54] METHOD OF MANUFACTURE OF AN ELECTROMAGNETICALLY ACTUATABLE FUEL INJECTION VALVE

[75] Inventor: Udo Hafner, Lorch, Fed. Rep. of Germany

[73] Assignee: Robert Bosch GmbH, Stuttgart, Fed. Rep. of Germany

[21] Appl. No.: 86,750

[22] Filed: Aug. 18, 1987

Related U.S. Application Data

[62] Division of Ser. No. 822,520, Jan. 27, 1986, Pat. No. 4,704,591.

[30] Foreign Application Priority Data

Mar. 2, 1985 [DE] Fed. Rep. of Germany ..... 3507441

[51] Int. Cl.[4] ..... H01F 7/06

[52] U.S. Cl. ..... 29/602.1; 29/460

[58] Field of Search ..... 29/602 R, 460; 335/229, 335/230, 266; 251/65, 129.15

[56] References Cited

U.S. PATENT DOCUMENTS

| | | | |
|---|---|---|---|
| 3,040,217 | 6/1962 | Conrad | 335/234 |
| 3,379,214 | 4/1968 | Weinberg | 335/234 |
| 4,506,701 | 3/1985 | Masaki et al. | 251/65 |
| 4,513,780 | 4/1985 | Evans | 251/129.21 |
| 4,525,695 | 6/1985 | Sheng et al. | 335/229 |
| 4,574,841 | 3/1986 | Hügler | 251/65 |

*Primary Examiner*—P. W. Echols

*Attorney, Agent, or Firm*—Edwin E. Greigg

[57] ABSTRACT

An electromagnetically actuatable fuel injection valve, which serves to supply fuel to mixture-compressing internal combustion engines having externally supplied ignition. The fuel injection valve includes a base plate into which pole pieces having bent poles are inserted. Magnetic coils are fitted onto the pole pieces. A first permanent magnet is inserted between the poles and a second permanent magnet is disposed between the magnetic conductor elements disposed on the other end of the pole pieces. Beginning at the base plate, the magnetic coils and the pole pieces are provided with a sprayed-on plastic jacket. The plastic jacket is inserted together with the base plate into an internal housing bore of a valve housing. A valve group is inserted into an outlet pipe of the valve housing which has an armature oriented toward the poles and joined with a valve needle which on its other end has a closing head that cooperates with a valve seat on a valve seat body and can be raised from the valve seat in the fuel flow direction.

1 Claim, 2 Drawing Sheets

FIG. 1
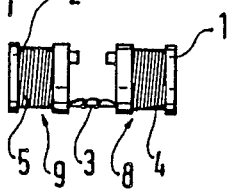
FIG. 2
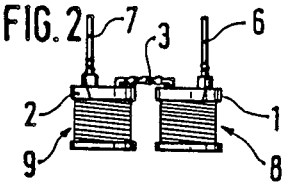
FIG. 5
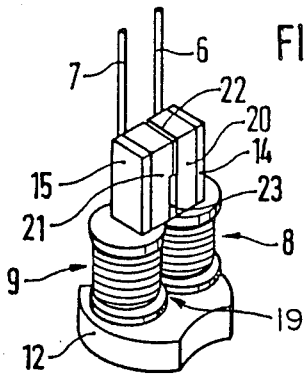
FIG. 3
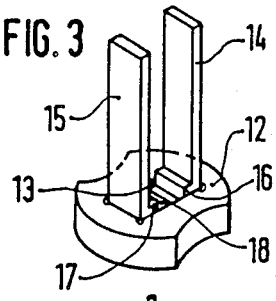
FIG. 6
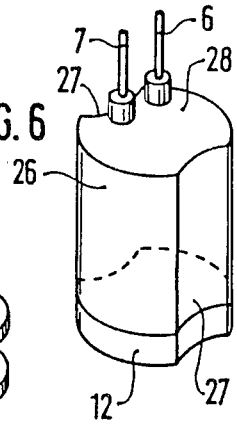
FIG. 4
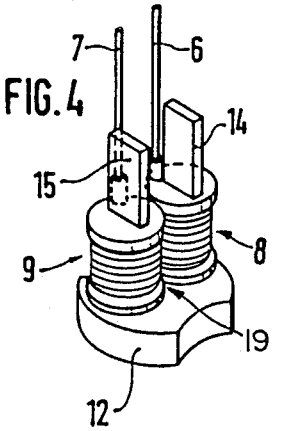
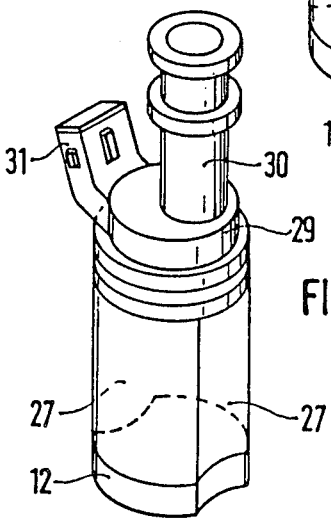
FIG. 7

METHOD OF MANUFACTURE OF AN ELECTROMAGNETICALLY ACTUATABLE FUEL INJECTION VALVE

This application is a division of application Ser. No. 822,520, filed Jan. 27, 1986 now U.S. Pat. No. 4,704,591.

BACKGROUND OF THE INVENTION

The invention is directed to an electromagnetically actuatable fuel injection valve and a method of manufacturing the valve.

OBJECT AND SUMMARY OF THE INVENTION

The fuel injection valve according to the invention and the method for manufacturing the valve have the advantage over the prior art that they enable simple and reliable mass production of the individual parts and simple and reliable mass assembly of the fuel injection valve.

A particularly advantageous feature is to provide the magnetic element as a whole with a plastic jacket that seals the magnetic element off from the fuel, so that it can be inserted as a single piece into the valve housing.

A further advantage is attained by leading the fuel from the fuel connection pipe to the valve closing element by way of a recess in the plastic jacket and in the base plate.

The invention will be better understood and further objects and advantages thereof will become more apparent from the ensuing detailed description of a preferred embodiment taken in conjunction with the drawings.

BRIEF DESCRIPTION OF THE DRAWINGS

FIGS. 1–7 show individual steps in the manufacture of the fuel injection valve according to the invention.

DESCRIPTION OF THE PREFERRED EMBODIMENT

Figure 8:
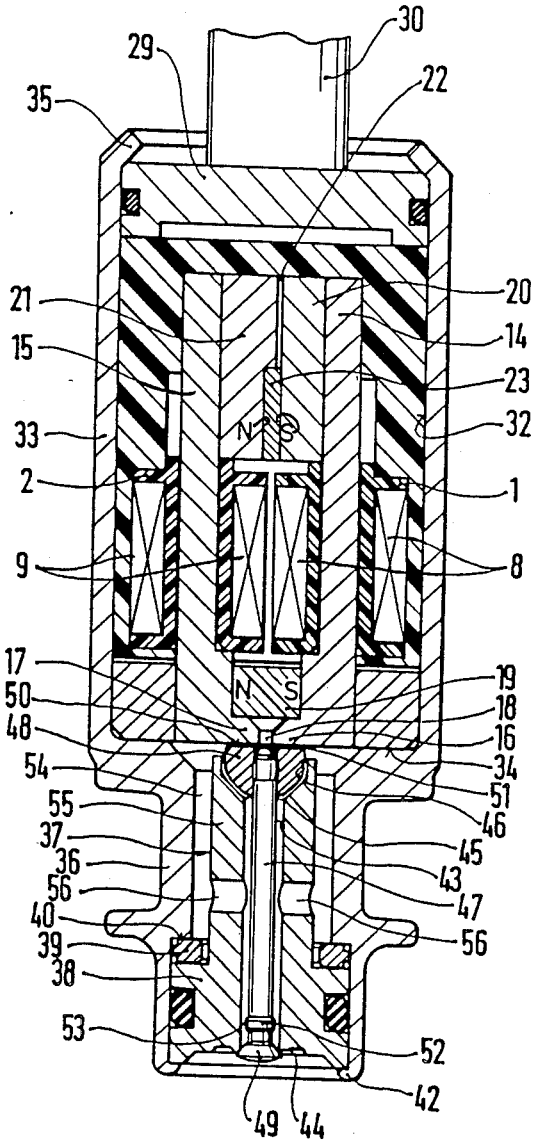
FIG. 8 shows a fuel injection valve embodied according to the invention.

The assembly of the exemplary embodiment of a fuel injection valve that is shown in FIG. 8 will first be explained in terms of the various steps in its manufacture shown in FIGS. 1–7. FIG. 1 shows a first coil body 1 and a second coil body 2 each of which include an aperture which forms a contact pin holder on one end and a rectangular slot therethrough. The coil bodies 1, 2 are formed of an insulator material such as extruded plastic parts and joined together by means of an elastic plastic clip 3 or an electrically conductive contact clip 3. Identical coil windings 4, 5 are wound onto the coil bodies 1, 2 in the same direction and are electrically connected in series, with the electrical connection being established either by means of the contact clip 3 or by extending the winding wire from one magnetic coil to the other via the plastic clip 3. A contact pin 6, 7 is inserted into the contact pin holder in each coil body 1, 2 and a different end of each of the coil windings 4, 5 is connected to the respective contact pins 6, 7. The coil bodies 1, 2 with the coil windings 4, 5 form a first magnetic coil 8 and a second magnetic coil 9. The coil windings 4, 5 are wound onto the coil bodies 1, 2 in a known manner using winding machines.

In a further method step, a first pole piece 14 and a second pole piece 15 are inserted into a rectangular recess 13 in a base plate 12. The pole pieces 14, 15 likewise have a rectangular cross section. The first pole piece 14 protrudes with a first pole 16, and the second pole piece 15 protrudes with a second pole 17, into the recess 13. The first pole 16 and the second pole 17 are bent with respect to the pole pieces 14, 15 and extend toward one another, so as to form a first air gap 18 between them. A first permanent magnet 19 is inserted between the poles 16, 17 in contact with each pole 16 and 17 as shown in FIG. 8.

In the next method step, the first magnetic coil 8 is fitted onto the first pole piece 14 via the rectangular slot therein and the second magnetic coil 9 is fitted onto the second pole piece 15 via the rectangular slot therein such that the magnetic coils 8, 9 are oriented parallel to one another, corresponding to the pole pieces 14, 15, and are seated on the base plate 12. On the end of the first pole piece 14 remote from the first pole 16 and protruding out of the first magnetic coil 8, there is a first ferromagnetic conductor element 20, and on the end of the second pole piece 15 remote from the second pole 17 and protruding out of the second magnetic coil 9, there is a second ferromagnetic conductor element 21. The magnetic conductor elements 20, 21 are oriented facing on another and between them they form a second air gap 22. A second permanent magnet 23 is disposed between the magnetic conductor elements 20, 21 within a portion of the second air gap 22.

Adjacent to the base plate 12, the pole pieces 14, 15 and the magnetic coils 8, 9 are now provided with a plastic jacket 26 sprayed tightly on over them, so that only the ends of the contact pins 6, 7 protrude out of the plastic jacket 26. The plastic jacket 26 and the base plate 12 have recesses 27 on their circumference that are in alignment with one another and extend in the longitudinal direction. In the exemplary embodiment shown, two recesses 27 are provided. A cap 29 having a fuel connection pipe 30 and an electric connection plug 31 is fitted onto the end face 28 of the plastic jacket 26 remote from the base plate 12. The electric connection plug 31 makes electrical contact via the contact plugs 6, 7. The magnetic element having the base plate 12 and the plastic jacket 26, together with the cap 29, is now inserted into an internal housing bore 32 of a valve housing 33 of the fuel injection valve. The internal housing bore 32 is stepped and has a shoulder 34 on which the base plate 12 rests. Remote from the shoulder 34, the rim of the valve housing 33 surrounds the periphery of the cap 29 partway and clamps the cap 29 and the magnetic part together axially by means of a crimped portion 35. An O-ring surrounds the cap 29 to prevent leakage from the housing.

Adjacent to the area receiving the magnetic coils 8, 9, the valve housing 33 includes an outlet pipe 36 of smaller diameter than the housing bore, in which the internal housing bore 32 continues and receives a preassembled valve group 37 having a valve seat body 38, which rests via an intermediate ring 39 on a support shoulder 40 of the internal housing bore 32. The rim of the outlet pipe 36, in the form of a crimped portion 42, grips the periphery of the valve seat body 38 partway and presses it in the direction of the support shoulder 40 against the intermediate ring 39. In the axial direction the valve seat body 38 has a continuous flow bore 43, which discharges to the outside into a fixed valve seat 44 formed on the valve seat body 38. Remote from the valve seat 44, the flow bore 43 merges with a beveled stop face 45, the diameter of which increases conically toward an adjacent cylindrical guide bore 46. The flow bore 43 is penetrated, with a large amount of play, by a valve needle 47 of a valve closing element, on one end of which an armature 48 in the form of a ball and made of ferromagnetic material is fixed; the armature 48 is slidably supported with little radial play in the guide bore 46. Remote from the armature 48, a valve closing head 49 which cooperates with the valve seat 44 is formed on the valve needle 47. The armature 48 has a flattened area 50 toward the pole pieces 14, 15, which serve as a core, and when the magnetic coils 8, 9 are not excited the armature 48 is attracted by the permanent magnetic field toward the poles 16, 17, with which however it still forms a residual air gap 51 when the closing head 49 is resting o the valve seat 44. In this position, the ball-like armature 48 has lifted away from the stop face 45. The radial guidance of the ball-shaped armature 48 is effected on its circumference, virtually by linear contact in the guide bore 46. Directly upstream of the valve closing head 49, a metering collar 52 is formed on the valve needle 47; with the wall of the flow bore 43, the metering collar forms a throttle restriction for the fuel and embodies an annular metering gap, at which approximately 90% of the pressure of the fuel drops, as compared with the ambient pressure prevailing downstream of the valve seat 44. The remaining 10% of the fuel pressure as compared with the ambient pressure drops at the flow cross section between the valve seat 44 and the closing head 49. Disposing the annular metering gap 53 directly upstream of the valve seat 44 has the advantage that the fuel metering is performed at a location at which the annular metering gap 53 is not stopped up by components of the intake tube atmosphere such as superfine dust and particles from recirculated exhaust gas, which would cause a change in the metered fuel quantity over the course of time in operation. The supply of fuel to the flow bore 43 is effected in an annular groove 54 between a step 55 of the valve seat body 38 and the internal housing bore 32, which at one end leads via the recess 27 in the jacket of the electromagnetic assembly to the fuel connection pipe 30 and at the other end of which there are radial bores 56 leading to the flow bore 43.

As already explained, when the magnetic coils 8, 9 are not excited the armature 48 is attracted toward the poles 16, 17 by the permanent magnetic field and thereby keeps the closing head 49 on the valve seat 44. If the magnetic coils 8, 9 are appropriately excited, a virtually identically large electromagnetic flux flows counter to the permanent magnetic flux at the armature 48, so that the pressure force of the fuel that engages the valve needle in the opening direction of the valve is sufficient to raise the closing head 49 from the valve seat 44, which enables the armature 48 to execute a stroke movement until it contacts the stop face 45. The stroke movement of the armature 48 or of the closing head 49 with respect to the valve seat 44 can be adjusted in a known manner prior to the fixation of the armature 48 on the valve needle 47. When the closing head 49 is moved outward, away from the valve seat 44, the fuel flowing to the valve seat 44 simultaneously centers the valve needle 47 in the flow bore 43.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for manufacturing a fuel injection valve, which comprises:

forming two coil bodies, winding a respective coil winding in the same direction onto said two coil bodies to form two magnetic coils, electrically connecting the coil windings in series, securing a contact pin to each of said coil bodies parallel with each other; connecting one end of each of said coil windings with each of said contact pins, forming a base plate with a recess therein, forming a first pole piece having a first bent pole and a second pole piece having a second bent pole, inserting the bent poles of said first and second pole pieces in said recess of said base plate with the bent poles facing each other, inserting a first permanent magnet between said first and second poles juxtaposed said bent poles, placing said first and second magnetic coils onto a respective pole piece, inserting a second permanent magnet between said first and second pole pieces remote from said base plate, enclosing said magnetic coils and said pole pieces in a plastic jacket above said base plate; forming a cap with a fuel pipe connection and an electric connection plug for making electrical contact with said contact pins; placing said cap onto the plastic jacket remote from the base plate with the electric connection plug in electrical contact with said contact pins, and inserting and securing the base plate-plastic jacket into one end of an internal housing bore of a valve housing in a sealed manner in which said housing includes in its opposite end a preassembled valve group having a valve seat body, a closing head and an armature.

* * * * *